US011088459B2

(12) United States Patent
Rebegea et al.

(10) Patent No.: US 11,088,459 B2
(45) Date of Patent: Aug. 10, 2021

(54) REFLECTOR FOR AN ANTENNA

(71) Applicant: HUAWEI TECHNOLOGIES CO., LTD., Guangdong (CN)

(72) Inventors: Serban Rebegea, Munich (DE); Christian Helbig, Munich (DE); Johann Baptist Obermaier, Munich (DE)

(73) Assignee: Huawei Technologies Co., Ltd., Shenzhen (CN)

( * ) Notice: Subject to any disclaimer, the term of this patent is extended or adjusted under 35 U.S.C. 154(b) by 69 days.

(21) Appl. No.: 16/586,494

(22) Filed: Sep. 27, 2019

(65) Prior Publication Data

US 2020/0099139 A1 Mar. 26, 2020

Related U.S. Application Data

(63) Continuation of application No. PCT/EP2017/057731, filed on Mar. 31, 2017.

(51) Int. Cl.

| | |
|---|---|
| ***H01Q 15/14*** | (2006.01) |
| ***H01Q 19/10*** | (2006.01) |
| ***H01Q 1/24*** | (2006.01) |

(52) U.S. Cl.

CPC ..... *H01Q 15/14* (2013.01); *H01Q 1/246* (2013.01); *H01Q 19/10* (2013.01)

(58) Field of Classification Search

CPC ..... H01Q 15/14; H01Q 1/24; H01Q 1/246; H01Q 1/38; H01Q 19/10

See application file for complete search history.

(56) References Cited

U.S. PATENT DOCUMENTS

| | | | | |
|---|---|---|---|---|
| 5,532,707 | A | 7/1996 | Klinger et al. | |
| 7,324,057 | B2 * | 1/2008 | Argaman | H01Q 15/162 343/779 |
| 7,358,924 | B2 * | 4/2008 | Boss | H01Q 1/246 343/853 |
| 9,590,317 | B2 * | 3/2017 | Zimmerman | H01Q 1/246 |
| 10,601,120 | B2 * | 3/2020 | Bisiules | H01Q 1/42 |
| 10,770,803 | B2 * | 9/2020 | Varnoosfaderani | H01Q 1/246 |
| 2001/0018793 | A1 | 9/2001 | McKinnon et al. | |
| 2004/0201537 | A1 | 10/2004 | Stolle et al. | |
| 2009/0066602 | A1 | 3/2009 | Lindberg et al. | |
| 2010/0182213 | A1 | 7/2010 | Obermaier et al. | |

(Continued)

FOREIGN PATENT DOCUMENTS

| | | |
|---|---|---|
| CN | 1985404 Y | 6/2007 |
| CN | 101479888 B | 6/2013 |

(Continued)

OTHER PUBLICATIONS

Office Action issued in Chinese Application No. 201780088783.5 dated Mar. 2, 2020, 15 pages (With English Translation).

(Continued)

*Primary Examiner* — Tho G Phan

(74) *Attorney, Agent, or Firm* — Fish & Richardson P.C.

(57) ABSTRACT

Examples reflectors for an antenna is provided. One example reflector comprises a support structure for supporting radiating elements and for providing mechanical stiffness of the reflector, and a separate conductive member acting as an electrically reflective surface attached to the support structure and covering at least a portion of the support structure.

15 Claims, 14 Drawing Sheets

(56) References Cited

U.S. PATENT DOCUMENTS

| | | | | |
|---|---|---|---|---|
| 2012/0075155 | A1* | 3/2012 | Lindmark | H01Q 19/106 343/797 |
| 2012/0280881 | A1 | 11/2012 | Beausang | |
| 2013/0307754 | A1 | 11/2013 | Williams et al. | |
| 2016/0329630 | A1 | 11/2016 | Mustajarvi et al. | |
| 2020/0067197 | A1* | 2/2020 | Tang | H01Q 9/285 |

FOREIGN PATENT DOCUMENTS

| | | | |
|---|---|---|---|
| CN | 203192938 | U | 9/2013 |
| CN | 203312457 | U | 11/2013 |
| CN | 105449361 | A | 3/2016 |
| DE | 4302905 | C1 | 3/1994 |
| JP | 2015050518 | A | 3/2015 |

OTHER PUBLICATIONS

PCT International Search Report and Written Opinion issued in International Application No. PCT/EP2017/057731 dated Jan. 3, 2018, 13 pages.

Office Action issued in Chinese Application No. 201780088783.5 dated Nov. 2, 2020, 6 pages (with English translation).

* cited by examiner

REFLECTOR FOR AN ANTENNA

CROSS-REFERENCE TO RELATED APPLICATIONS

This application is a continuation of International Application No. PCT/EP2017/057731, filed on Mar. 31, 2017, the disclosure of which is hereby incorporated by reference in its entirety.

TECHNICAL FIELD

The invention relates to the field of reflectors for antennas and, more particularly, to reflectors for base station antennas.

BACKGROUND

A base station antenna is provided with a reflector for ensuring a support of radiating elements and for reflecting electrical signals from the radiating elements. A typical state of the art reflector is made of a sheet metal of a homogeneous surface, for example made of aluminum and, depending on its material, size and number of elements, it has a certain weight. This weight is a significant factor for the entire weight of the antenna.

The antenna comprises at least one radiating element, and usually comprises further electrically conductive components in order to shape a beam of the radiating element. The electrically conductive components are usually arranged in the vicinity of the radiating elements. Further, the electrically conductive components, typically called beam forming elements, are usually provided as separate parts being separately manufactured and requiring additional assembly steps. The radiating elements and usually also the beam forming elements have to be galvanically or capacitively connected to the reflector.

Basically, in the context of this description, "electrically conductive" means conductive for alternating currents at the frequency of the radiated signals of the antenna, "electrically non-conductive" means non-conductive for alternating currents at the frequency of the radiated signals of the antenna, and "reflective" means reflective for alternating currents at the frequency of the radiated signals of the antenna.

There is a general target to reduce the weight of antennas in order to facilitate the installation, mounting and maintenance of the antennas which require a lot of manual handling in a difficult environment since required man hours are an important cost factor. Another aspect for reducing the weight is to reduce requirements to the site structure, in particular, strength and costs of the mast, and installation costs.

Typical weight reduction techniques include a selection of lightweight materials with low density and high stress tolerance. By varying material properties such as thickness or composition, lower weight components can be manufactured. However, due to mechanical limitations, features like thickness reduction and low density materials cannot be infinitely performed. Some materials cannot be used because they are not suitable for PIM (Passive Intermodulation) stable designs. Therefore, structures made of e.g. carbon fiber compounds are normally not suitable.

SUMMARY

It is therefore an object of the present invention to remedy the above-mentioned disadvantages and to provide a reflector having a reduced weight.

The object is achieved by the features of the independent claim. Further developments of the invention are apparent from the dependent claims, the description and the figures.

According to an aspect, a reflector for an antenna (e.g. a base station antenna) comprises a support structure for supporting at least one radiating element and for providing mechanical stiffness of the reflector and a separate conductive member acting as an electrically reflective surface attached to the support structure and covering at least a portion of the support structure.

Since a support structure for providing mechanical stiffness and a separate conductive member for reflecting radiated signals are provided, these two constituents of the reflector can be separately optimized in regard of reduction of weight and functional characteristics. The shape of the support structure can be e.g. realized such that the shapes of functional elements such as e.g. beam forming elements, cable holders, supporting structures for radiating elements, radome, phase shifters etc., connecting structures like welding pads for further additional connectors, or for hole integration, snap-fits or any other type of interconnection, sliders to insert additional elements like a PCB (printed circuit board), welding pads etc. are already integrated in the support structure which can easily be covered by the conductive member. The conductive member can be attached to the support structure by an adhesive layer or by any other suitable kind of attachment.

According to a first implementation of the reflector according to the aspect, the support structure has a plurality of notches.

By providing notches, a weight of the support structure of the reflector can be decreased since the notches are formed by generating holes in the support structure. The holes are generated by completely removing material from the support structure or by reshaping cutout portions of the support structure such that aforementioned additional functions are provided by the reshaped material which, in turn, saves weight since additional members for achieving the additional functions are not necessary. By providing the notches, the volume of the support structure and, therefore, its weight can be reduced.

According to a second implementation of the reflector according to the first implementation, the support structure comprises support portions for supporting the radiating elements and joint portions adjacent to the notches such that the support portions are connected to one another by the joint portions.

By providing the notches having a suitable size and location, areas of the support portions for supporting the radiating elements adjacent to the notches and shape of the joint portions adjacent to the notches can be optimized in view of providing a required strength and stiffness of the support structure for the radiating elements and having a reduced volume in order to reduce weight.

According to a third implementation of the reflector according to the second implementation, the support structure comprises attachment portions for attaching the support structure to a housing of the antenna or to an external fixing system, and the support portions adjacent to the notches are connected to the attachment portions by the joint portions.

For attaching the support structure to a housing of the antenna or to an external fixing system in a manner such that weight is reduced, joint portions optimized in view of providing a required strength and stiffness for the radiating elements and having a reduced size by providing the adjacent notches having a suitable size and location are provided between the support portions and the attachment portion.

According to a fourth implementation of the reflector according to anyone of the second or third implementation, the joint portions are strut-shaped portions.

Joint portions being strut-shaped provide a simple shape being easy to be configured so as to provide a required strength and stiffness for the radiating elements and to be reduced in volume.

According to a fifth implementation of the reflector according to anyone of the first to fourth implementation, the separate conductive member covers at least some of the notches.

When at least some of the notches are covered, a partially continuous electrically reflective surface which is reduced in weight can be generated.

According to a sixth implementation of the reflector according to anyone of the second to fifth implementation, the support structure comprises a plate-shaped section, and the plate-shaped section comprises a protruding portion, wherein the protruding portion is formed by a cut out portion, the cut out portion being separated from the plate-shaped section along a contour of at least one of the notches except at an edge of the joint portion adjacent to the at least one of the notches and folded along the edge such as being protruding from the plate-shaped section.

The protruding portion protruding from the plate-shaped section of the support structure enables an easy integration of additional functions into the support structure. Moreover, since the protruding portion is formed by the cut out portion separated from the plate-shaped section of the support structure along the contour of the notch except at the edge of the joint portion adjacent to the notch, forming of the protruding portion and generating the notch can be performed in integrated manufacturing steps.

According to a seventh implementation of the reflector according to the sixth implementation, the protruding portion is formed by a piece of the cut out portion.

By merely using a piece of the cut out portion, the size and the shape of the protruding portion can be reduced independently with respect to the size and the shape of the notch so that the protruding portion is smaller than the notch such that an appropriate shape of e.g. a beam forming element can be achieved and the size and, therefore, the weight of the beam forming element can maximally be reduced.

According to an eighth implementation of the reflector according to the sixth or seventh implementation, the protruding portion comprises a fixation element for fixing a further member to the support structure or for fixing the support structure to a housing of the antenna or to an external fixing system.

The protruding portion comprising the fixation element, e.g. a hole, a nut or a latch, enables an easy fixation of the further member, e.g. a radiating element, a beam shaping element, a phase shifter, or a radome, in a simple manner without the use of further separate specific fixation elements, such as brackets, which would cause additional component costs and assembly effort.

According to a ninth implementation of the reflector according to anyone of the sixth to eighth implementation, the support structure comprises at least one additional reinforcement member connected to one of the support portions and/or to at least one of the joint portions adjacent thereto.

The use of an additional reinforcement member connected to one of the support portions and/or to at least one of the joint portions adjacent thereto enables a specific reinforcement of an area of the support structure where e.g. a heavier element is to be attached. The provision of the reinforcement member safes increasing the stability of the rest of the support structure and subsequently the increase of its total weight. On the other hand, it would be necessary e.g. to increase the thickness and, therefore, the weight of the entire support structure or to choose a stronger material with eventually higher density and, therefore, to increase the weight of the entire support structure again.

According to a tenth implementation of the reflector according to anyone of the sixth to ninth implementation, the support structure is made of sheet metal.

Compared to its thickness and, therefore, its weight, the sheet metal provides a large strength and stiffness.

According to an eleventh implementation of the reflector according to the aspect or to anyone of the first to ninth implementation, the support structure is made of a non-conductive material.

By using a non-conductive material as a dielectric element which separates at least two conductive members, a capacitive coupling of at least two opposite conductive members is facilitated.

According to a twelfth implementation of the reflector according to the aspect or to anyone of the preceding implementations, the conductive member is a conductive foil.

The conductive foil enables an easy adjustment of a size and shape of the conductive member to a size and shape requested due to the support structure and functional characteristics of several portions of the reflector. Furthermore, the foil can be very thin, since the electrical function of reflectivity doesn't require a relevant thickness, and is therefore lightweight so that it scarcely contributes to the weight of the reflector.

According to a thirteenth implementation of the reflector according to the aspect or to anyone of the preceding implementations, the conductive member is configured to be attached to the support structure by mechanical fixtures.

Instead of or additionally to the adhesive layer, the conductive member is attached to the support structure by mechanical fixtures. The mechanical fixtures can be e.g. rivets or heat stacking pins. The connection between the conductive member and support structure is to be designed in such a way that no negative influence on the RF performance occurs, e.g. the connection is to be electrically coupling, the connection must not reveal Passive Intermodulation, etc.

According to a fourteenth implementation of the reflector according to the aspect or to anyone of the preceding implementations, the support structure has a front side directed in a predetermined direction defined by a direction of beam of RF signals of the antenna, and the conductive member is configured to be attached to the front side.

By attaching the conductive member on the front side of the support structure, a direct reflection of the radiated signals of the support structure is possible, wherein the reflection is undistorted by any possible effect.

According to a fifteenth implementation of the reflector according to the aspect or to anyone of the first to thirteenth implementations, the support structure has a backside averted from a predetermined direction defined by a direction of beam of RF signals of the antenna, and the conductive member is configured to be attached to the backside.

The attachment of the conductive member to the backside enables for example a simple soldering or capacitively coupling of electrical elements connected to the conductive member. Such an electrical element can include a PCB which provides baluns for example. The benefit of this implementation of baluns is that they are electrically isolated from the radiating elements by the conductive member. Such a PCB can also provide an interface to a feeding cable. The benefit of this interface is that there is no penetration of the conductive member.

BRIEF DESCRIPTION OF THE DRAWINGS

In the following detailed portion of the present disclosure, the invention will be explained in more detail with reference to the exemplary embodiments shown in the drawings, in which.

Identical reference signs are used for identical or at least functionally equivalent features.

DETAILED DESCRIPTION OF EMBODIMENTS OF THE INVENTION

Figure 1:
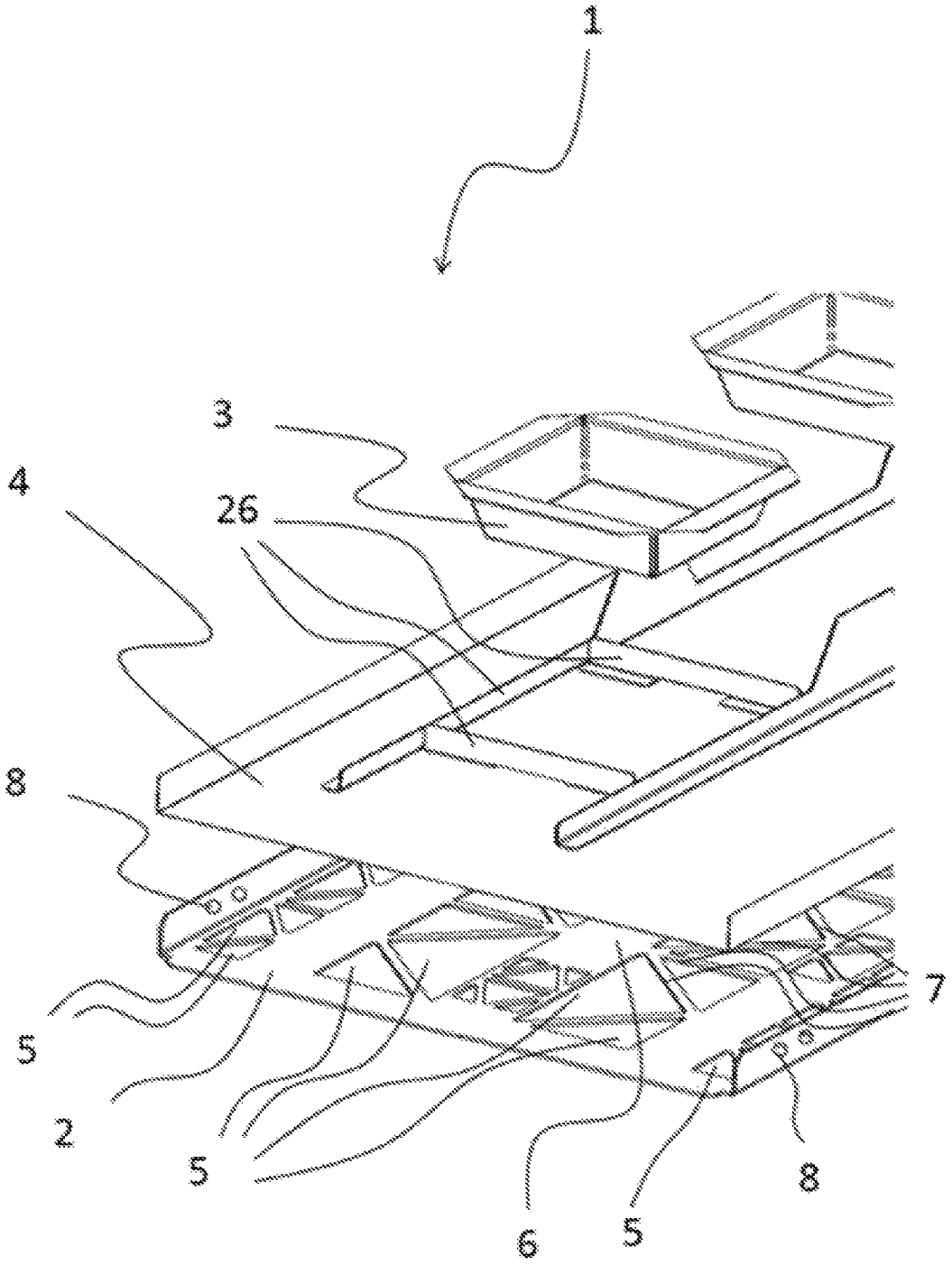
FIG. 1 shows a perspective exploded view of a portion of a reflector according to an embodiment of the invention.

FIG. 1 shows a perspective exploded view of a portion of a reflector 1 according to an embodiment of the invention. The reflector 1 is a component of an antenna, in particular of a base station antenna. The reflector 1 comprises a support structure 2 for supporting radiating elements 3 and for providing mechanical stiffness of the reflector 1 and a separate conductive member 4 providing an electrically reflective surface attached to the support structure 2 and covering at least a portion of the support structure 2. Furthermore, beam forming elements 26 are attached to the support structure 2.

The support structure 2 is for example made of sheet metal. Alternatively, merely a portion of the support structure 2 is made of sheet metal and remaining portions are made of e.g. molded plastic parts.

The sheet metal consists of aluminum; however, steel or another conductive material are alternatively possible. Furthermore, the support structure can be made of or include a diecasted member, an injection molded member, a member made by a SMC process or a member made of a carbon composite or metal foam. Other possible options for manufacturing the support structure are e.g. milling, waterjet cutting, laser cutting, wire cutting or punching. Furthermore, the support structure can be chemically processed, as e.g. by photo polymers.

Alternatively, the support structure 2 can be made of a non-conductive material, e.g. plastic.

Figure 2:
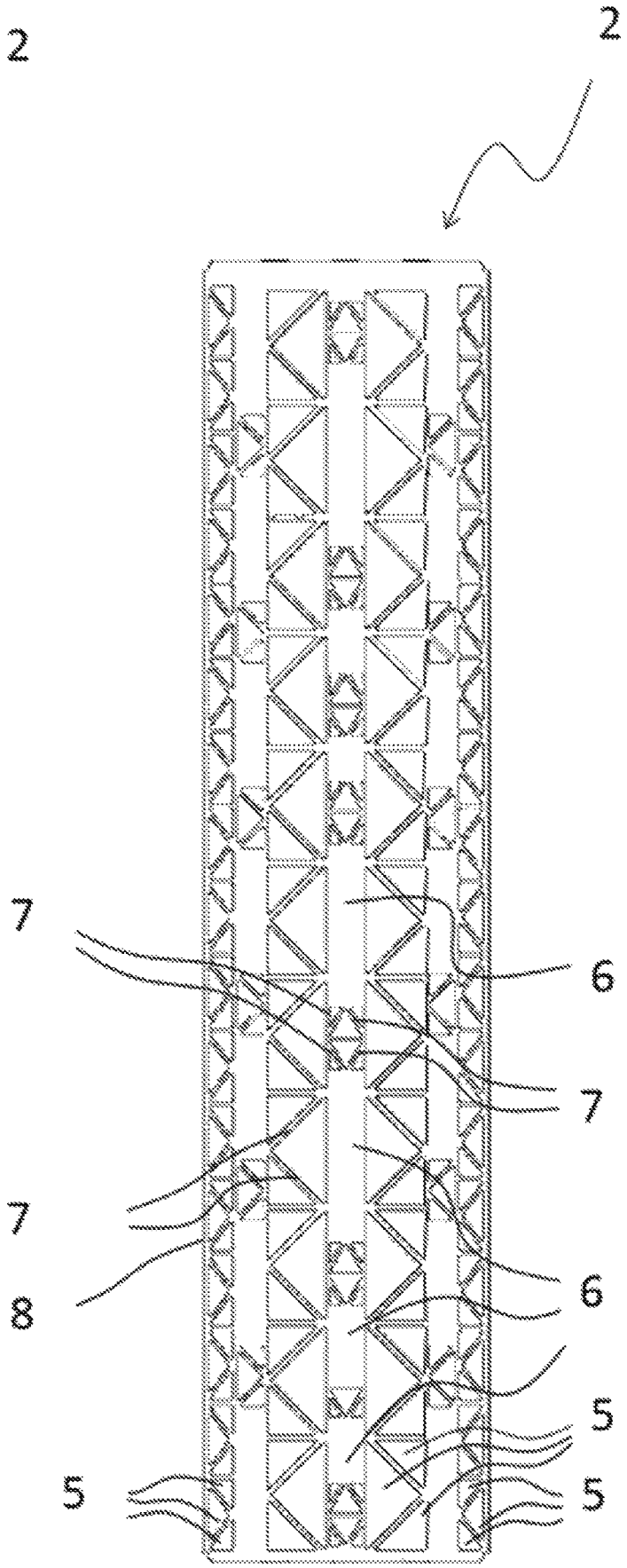
FIG. 2 shows a plan view of a support structure of the reflector of FIG. 1.

As shown also in FIG. 2 which shows a plan view of the support structure 2 of the reflector 1 of FIG. 1, the support structure 2 has a plurality of notches 5 for a decrease in weight of the reflector 1. As to be seen, the notches 5 are areas where a material of the support structure is removed so that holes are formed in the support structure. Alternatively, recesses are formed by reducing a wall thickness of the support structure. The holes or recesses are formed at locations which do not or merely little contribute to a strength and a stiffness of the support structure.

The support structure 2 further comprises support portions 6 for supporting the radiating elements 3 and joint portions 7 adjacent to the notches 5 such that the support portions 2 are connected to one another by the joint portions 7.

Furthermore, the support structure 2 comprises attachment portions 8 for attaching the support structure 2 to a housing (not shown) of the antenna or to an external fixing system (not shown), and the support portions 6 adjacent to the notches 5 are connected to the attachment portion 8 by the joint portions 7. The joint portions 7 are strut-shaped portions. Due to this configuration, the support structure 2 has the shape of a skeleton. Alternatively, the support structure 2 can be attached to the housing or to the external fixing system by other members attached to or integrated in the support structure 2.

As to be seen in FIG. 1, the separate conductive member 4 covers at least some of the notches 5. In this embodiment, the separate conductive member 4 furthermore covers the joint portions 7 and the attachment portions 8. However, in an alternative embodiment, the separate conductive member 4 merely covers an area of the support structure 2 which is necessary for providing a requested function. Furthermore, several separate conductive members 4 are possible.

Figure 3A:
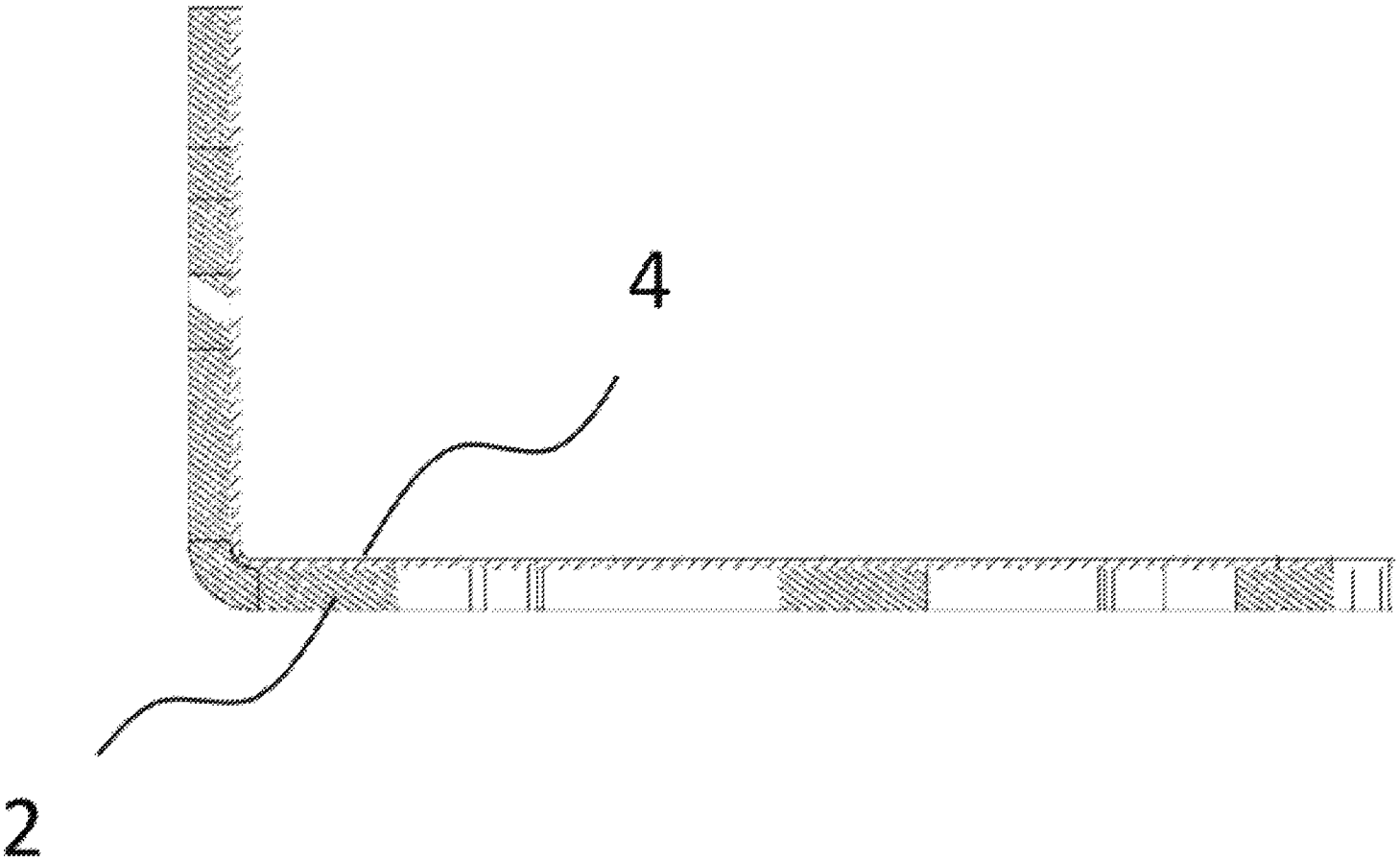
FIG. 3*a* shows a principle sectional side view of the support structure with a conductive member placed on a front side of the support structure.
Figure 3B:
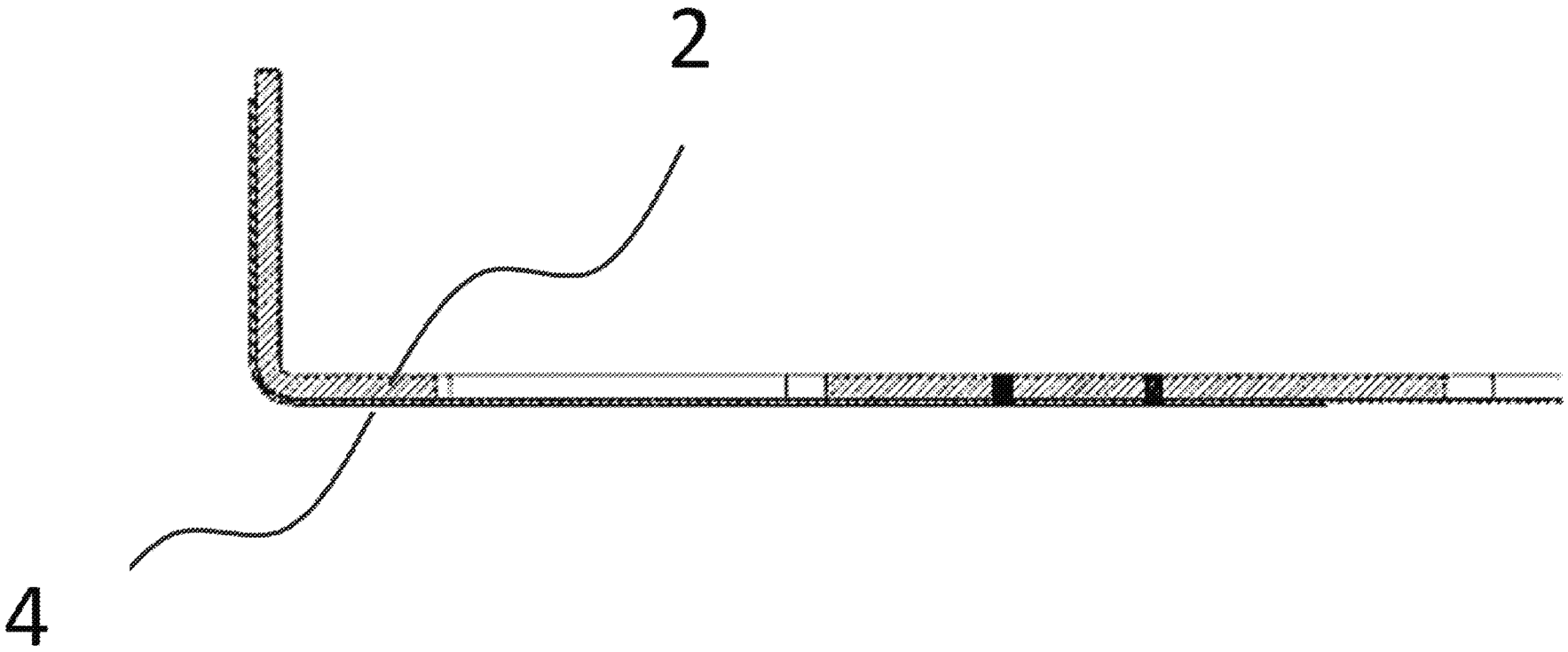
FIG. 3*b* shows a principle sectional side view of the support structure with the conductive member placed on a backside of the support structure.

FIG. 3*a* (as also FIG. 1) shows a principle sectional side view of a section the support structure 2 with the separate conductive member 4 placed on a front side of the support structure 2. The front side is defined such that the support structure 2 has the front side directed in a predetermined direction defined by a direction of beam of RF signals of the antenna and the conductive member 4 is configured to be attached to the front side.

Alternatively, as shown in FIGS. 3*b* and 4*a* to 4*c*, in a principle sectional side view of the support structure 2, the conductive member 4 is placed on a backside of the support structure 2. The backside is defined such that the support structure 2 has the backside averted from the predetermined direction defined by the direction of beam of RF signals of the antenna and the conductive member 4 is configured to be attached to the backside. In some embodiments, in this configuration, the support structure is electrically transparent.

Figure 4A:
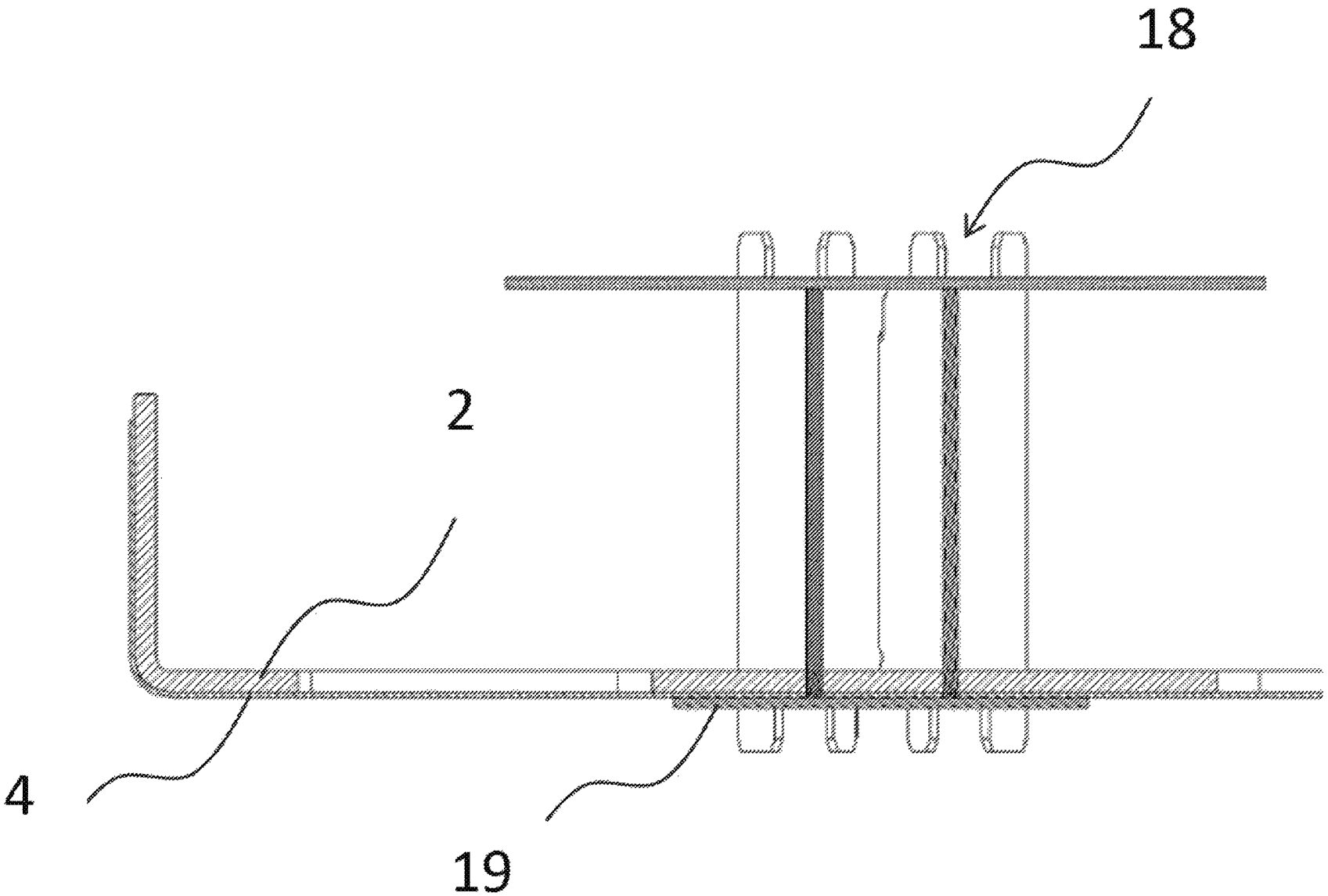
FIG. 4*a* shows a principle sectional side view of the support structure with the conductive member placed on the backside of the support structure and a radiating element.

FIG. 4*a* additionally shows a radiating element 18. The radiating element 18 is attached to the backside of the support structure 2 and, furthermore, a printed circuit board 19 of the radiating element 18 is connected to the conductive member 4 e.g. by soldering. In this configuration, multiple elements can be soldered at once from the backside of the reflector. In an alternative embodiment, the electrical and/or mechanical fixture can be realized directly between radiating element lashes and the conductive member 4 e.g. by soldering. Then, the printed circuit board 19 can be omitted.

In a further alternative embodiment any other kind of radiating element (dicasted, sheet metal, metalized plastic, etc) can be used.

Figure 4B:
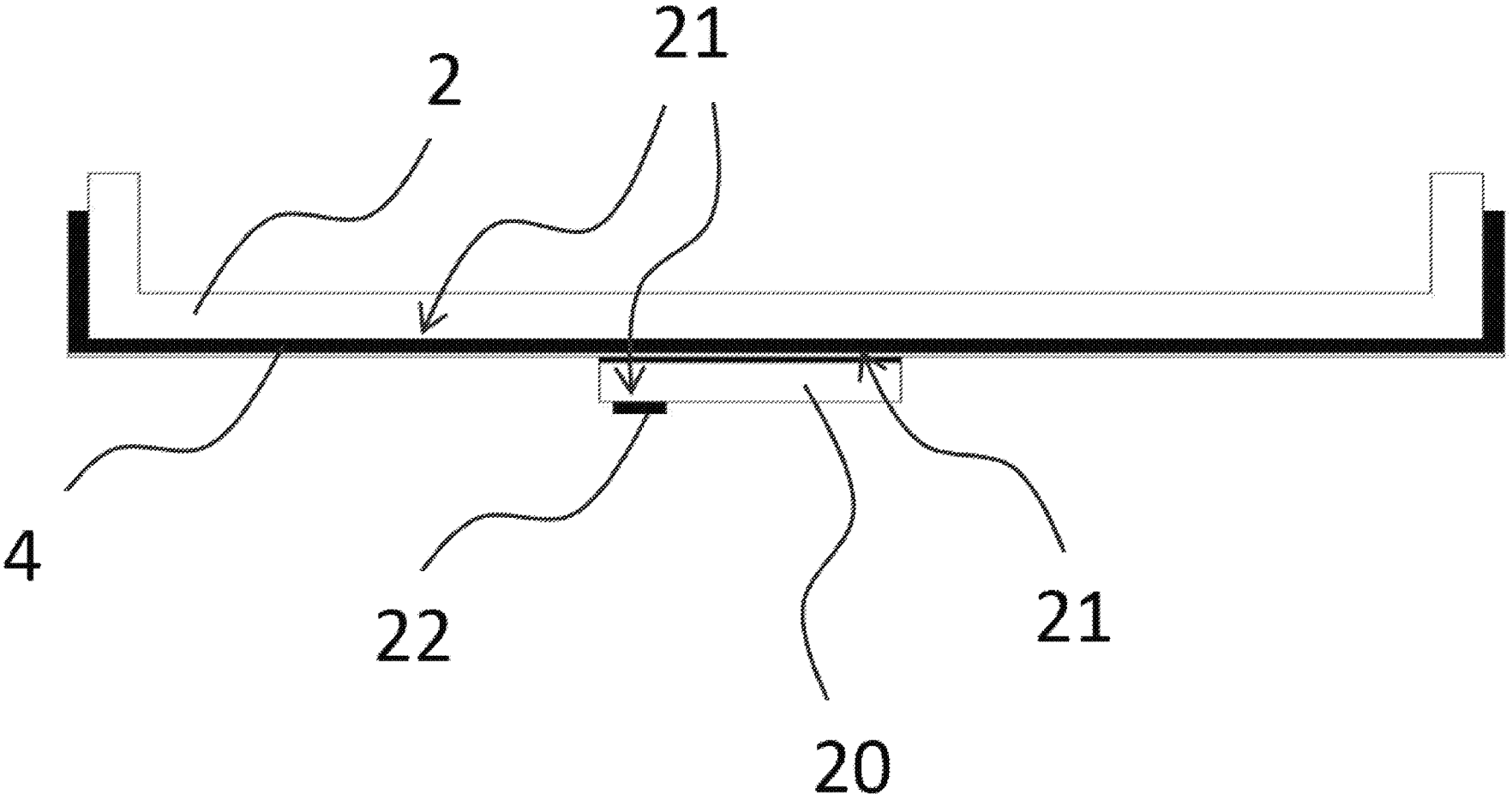
FIG. 4*b* shows a principle sectional side view of the support structure with the conductive member placed on the backside of the support structure and electrical structures providing a balun.

In FIG. 4*b* which is a principle sectional side view, the support structure 2 is shown with a PCB 20. The PCB 20 is connected to the conductive member 4 by a conductive surface 21. The conductive member 4 is connected to the support structure also via the conductive surface 21. The PCB 20 is provided with electrical structures 22 here generating a balun.

Figure 4C:
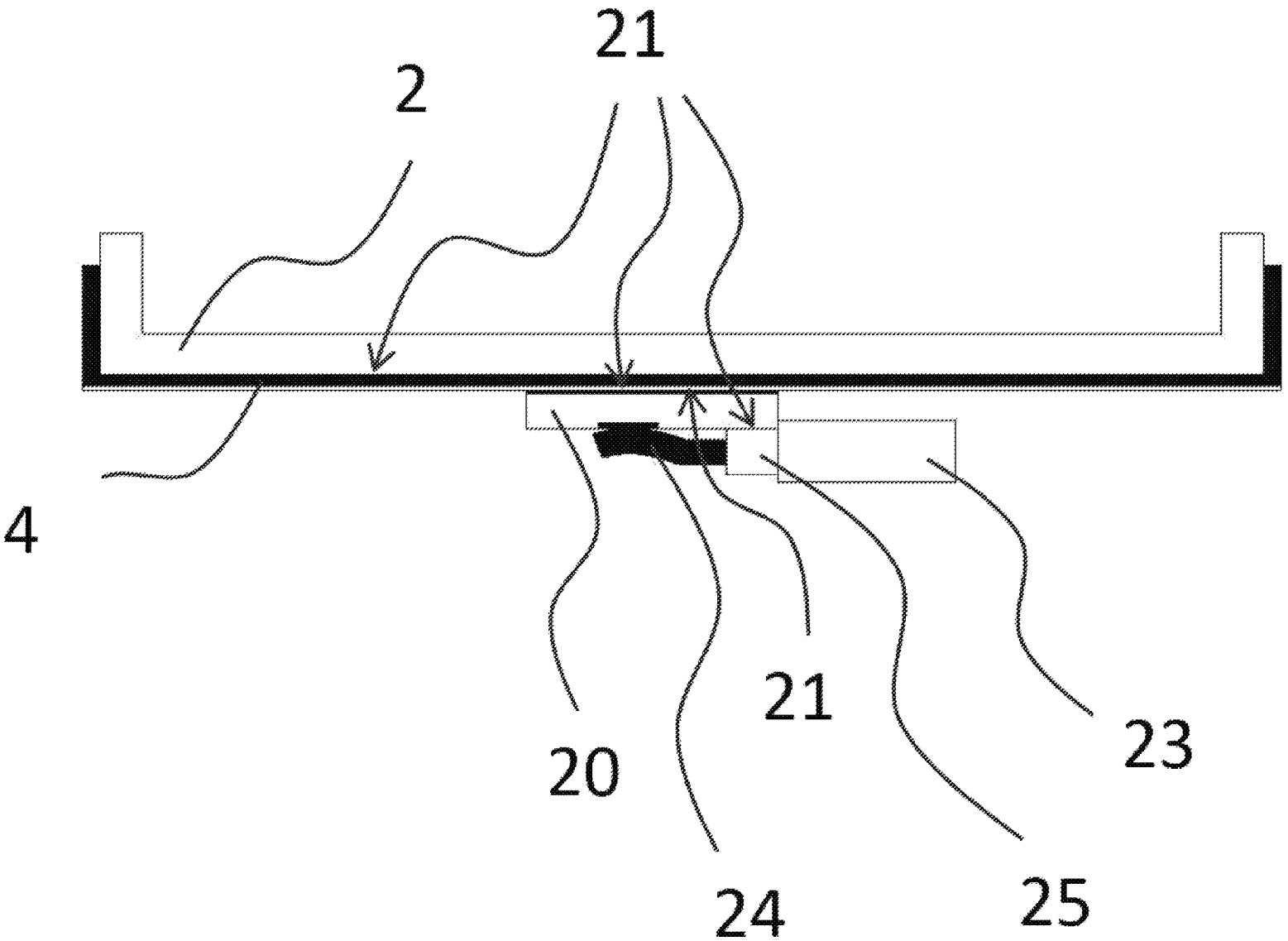
FIG. 4*c* shows a principle sectional side view of the support structure with the conductive member placed on the backside of the support structure and a PCB connected to a cable.

FIG. 4*c* shows a principle sectional side view of the support structure 2 with the PCB 20 connected to a feeding cable 23. The PCB 20 is connected to the conductive member 4 by the conductive surface 21. The conductive member 4 is connected to the support structure also via the conductive surface 21. The feeding cable 23 is provided with an inner conductor 24 and with an outer conductor 25. The inner conductor 24 and the outer conductor 25 are respectively connected to the PCB 20 via the conductive surfaces 21.

Figure 5:
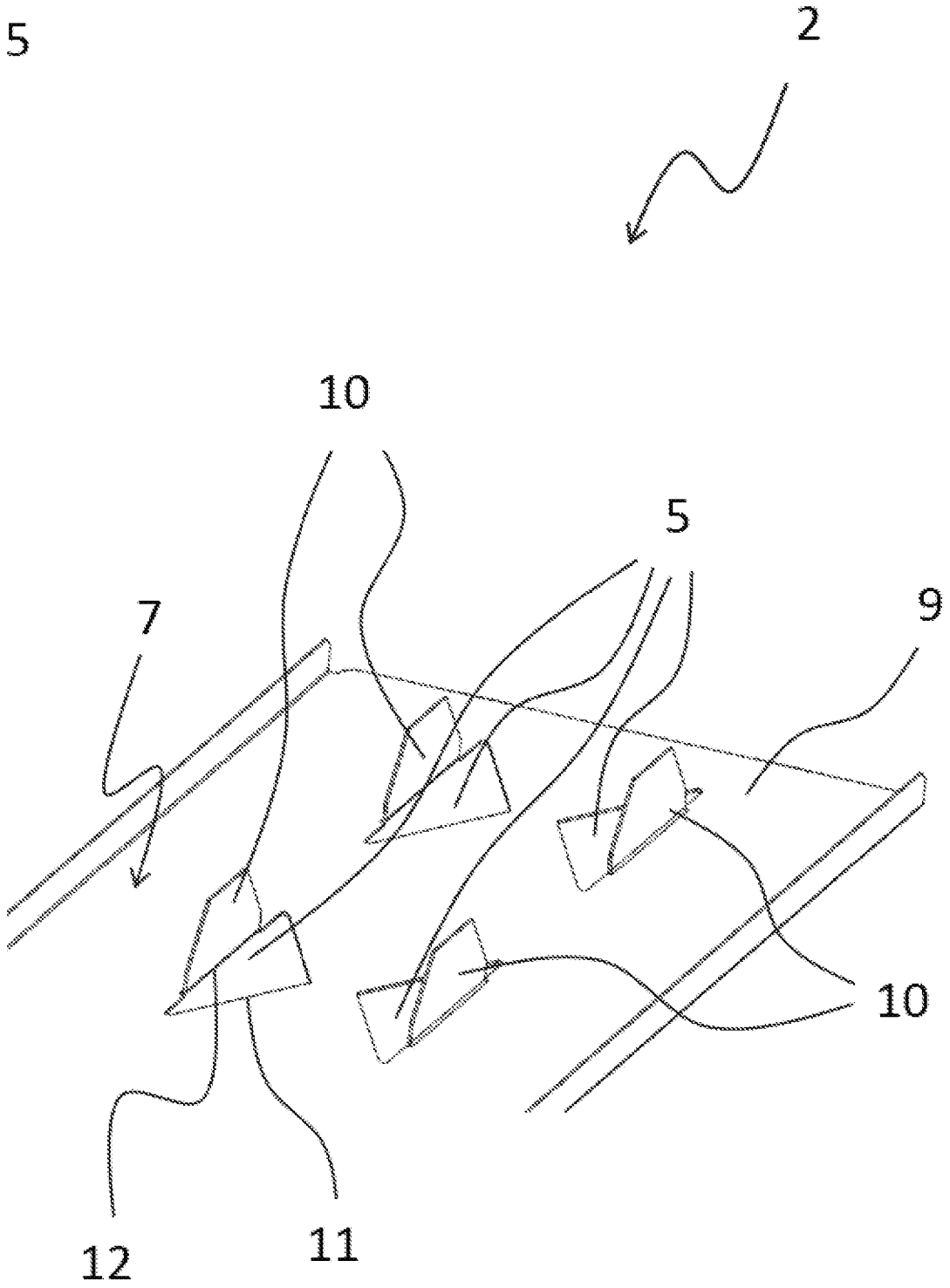
FIG. 5 shows a perspective view of a portion of the support structure provided with protruding portions.

FIG. 5 shows a perspective view of a portion of an embodiment of the support structure 2 provided with protruding portions 10. The support structure 2 comprises a plate-shaped section 9 comprising the protruding portion 10, wherein the protruding portion 10 is formed by a cut out portion separated from the plate-shaped section 9 along a contour 11 of at least one of the notches 5 except at an edge 12 of the joint portion 7 adjacent to the at least one of the notches 5 and folded along the edge 12 such as being protruding from the plate-shaped section 9. The protruding portion 10 shown in FIG. 5 is formed as being a beam forming element.

The protruding portion 10 is formed by a piece of the cut out portion which has a smaller area than that of the related notch 5. As to be seen in FIG. 5, the cutout portion forming the protruding portion 10 is not folded along the entire edge 12 of the joint portion 7 adjacent to the notch 5. At the edge 12, beside the folded cutout portion forming the protruding portion 10, remaining portions of the edge 12 are cut off and, furthermore, compared to a shape of the notch 5, a tip of the cutout portion is truncated so that the size and the shape of the protruding portion 10 are reduced independently from the size and the shape of the notch 5 such that an appropriate shape of e.g. a beam forming element is achieved. Furthermore, the size of the notch 5 can be maximized independently from the shape of the protruding portion 10 so that a reduction of weight can be maximized.

The protruding portions can also be formed in a rib-like manner along the edge 12. Hence, the protruding portion 10 acts as a reinforcing rib. By such a reinforcing rib, the strength and stiffness of the strut-shaped joint portion 7 can be enhanced, in particular, if the reinforcing rib is bent about an angle of about 90 degree in order to increase the section modulus of the strut-shaped joint portions 7 and, therefore, of the plate-shaped section 9.

Figure 6:
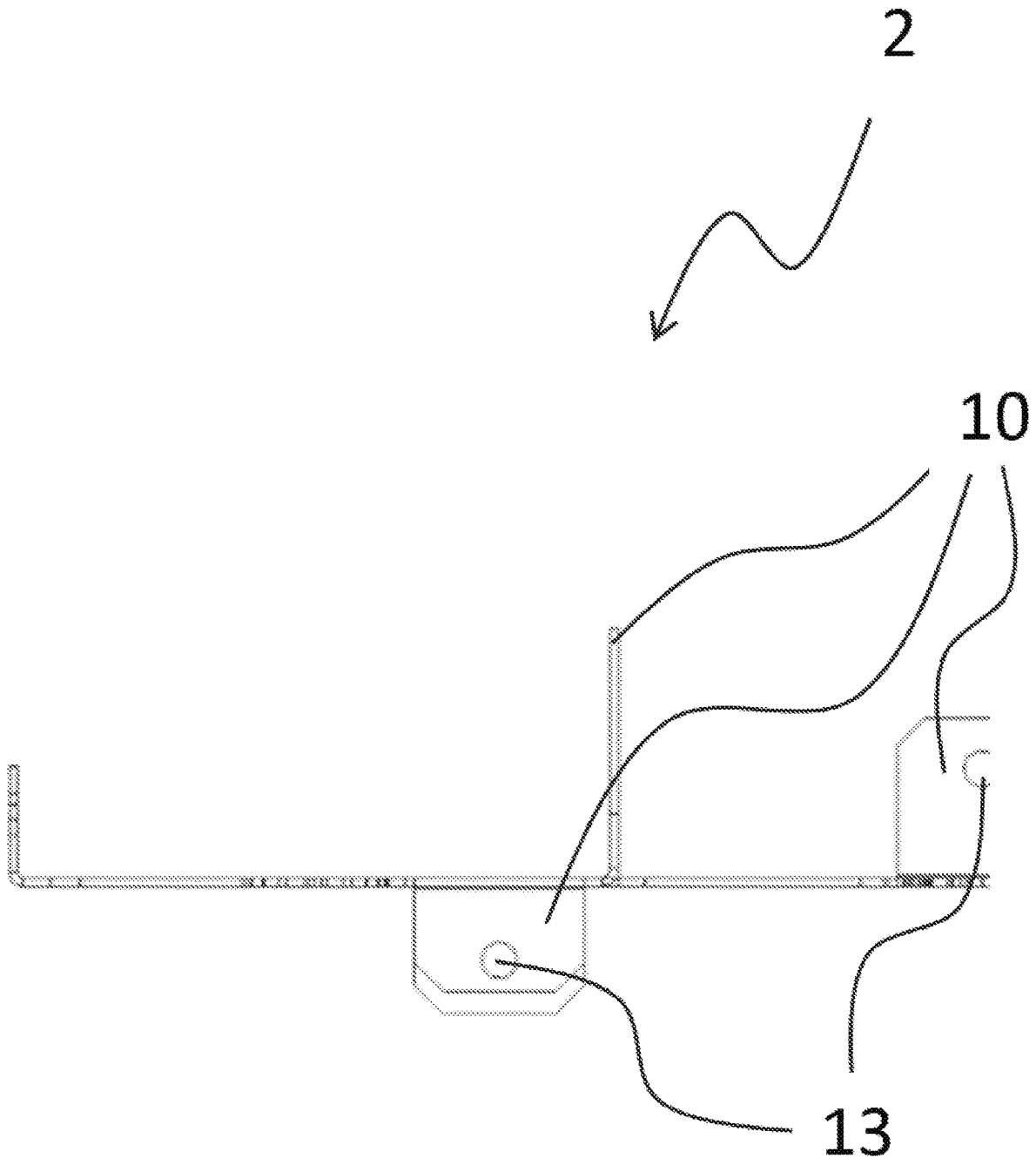
FIG. 6 shows a sectional side view of a section of the support structure provided with the protruding portions comprising fixation elements.

FIG. 6 shows a sectional side view of a section of the support structure 2 provided with the protruding portions 10 comprising a fixation element 13 for fixing a further member to the support structure 2 or for fixing the support structure 2 to a housing of the antenna or to an external fixing system. Further members can be e.g. a phase shifter, a combiner or a radome. The further members are attached to the support structure 2 by the fixation elements 13. Here the fixation elements 13 are configured as holes but, alternatively, e.g. latches, nuts or brackets can be provided.

Figure 7:
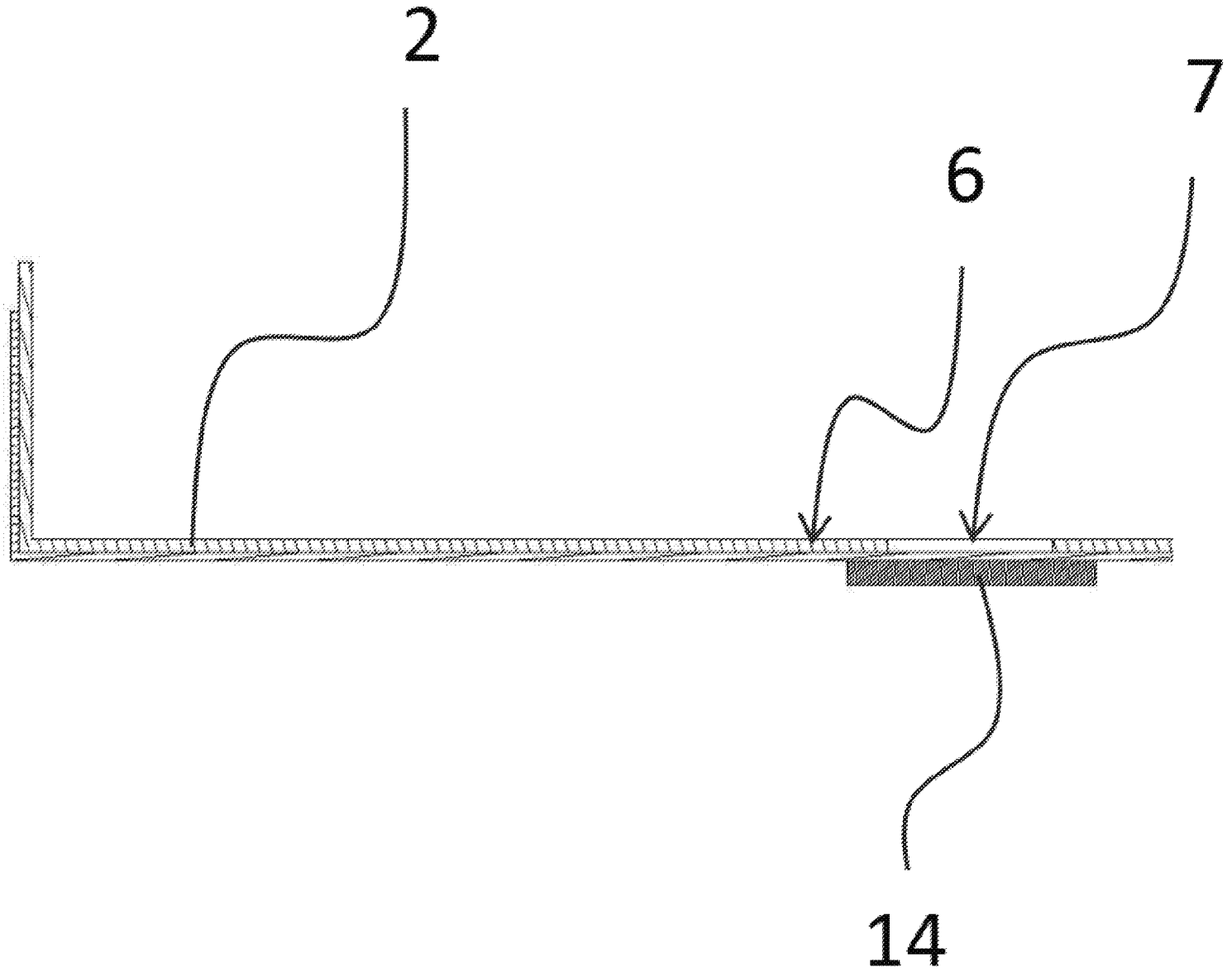
FIG. 7 shows a principle sectional side view of the support structure comprising an additional reinforcement member.

FIG. 7 shows a principle sectional side view of the support structure 2 comprising an additional reinforcement member 14. The support structure 2 comprises at least one additional reinforcement member 14 connected to one of the support portions 6 and/or to at least one of the joint portions 7 adjacent thereto. Depending on the requirements to strength and stiffness of the support structure 2, the reinforcement member 14 is connected to the support portion 6 and/or to the joint portion 7 e.g. by bonding, brazing, welding or by rivets or bolts. In case that the support structure 2 is made by a molding process, the reinforcement member 14 can be integrated in the support structure 2 as a thickened portion or by being overmolded. By the reinforcement member 14, the support structure 2 can be locally reinforced in order not to unnecessarily increase the weight of the support structure 2.

Figure 8:
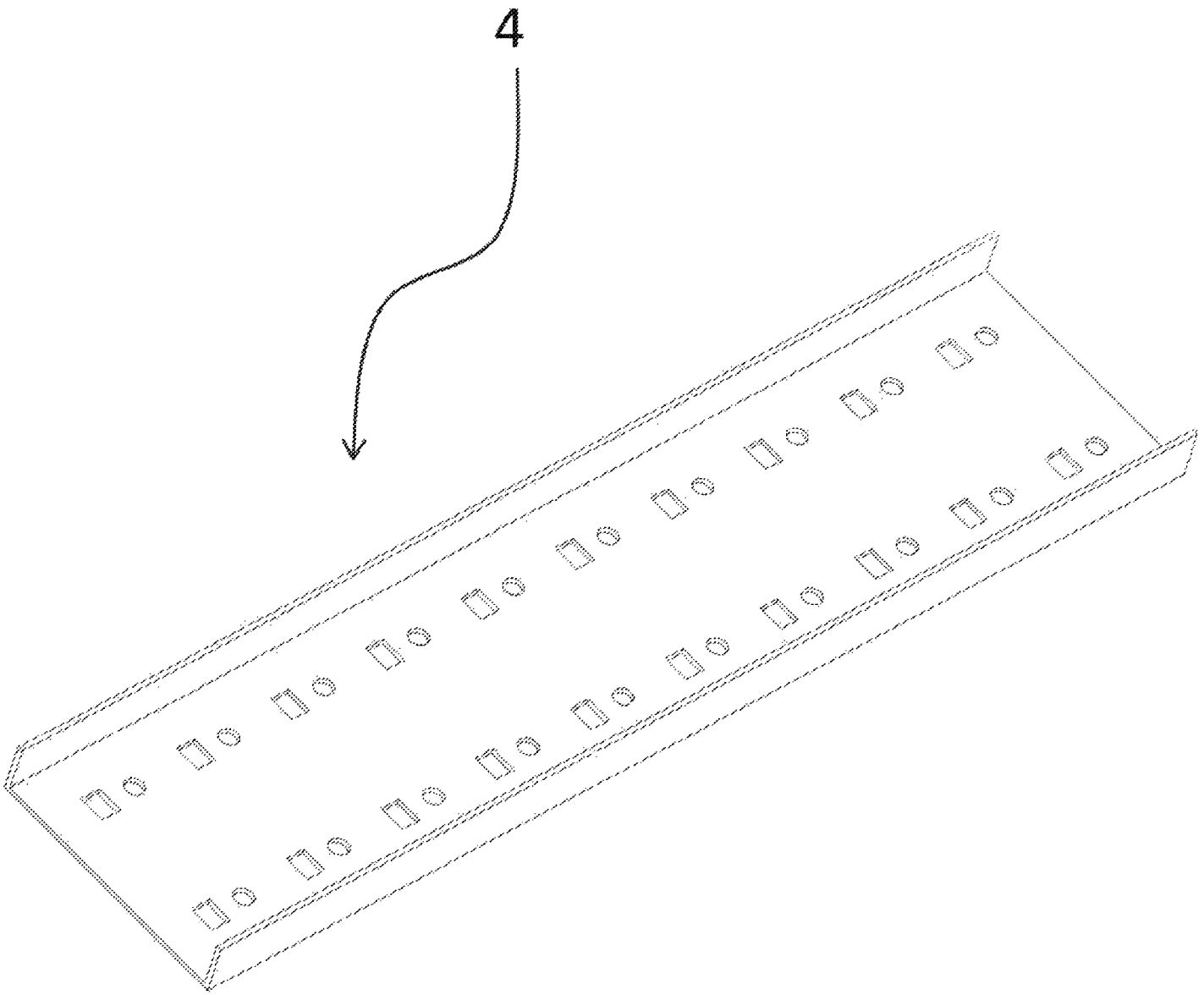
FIG. 8 shows a perspective view of a single piece conductive member.
Figure 9:
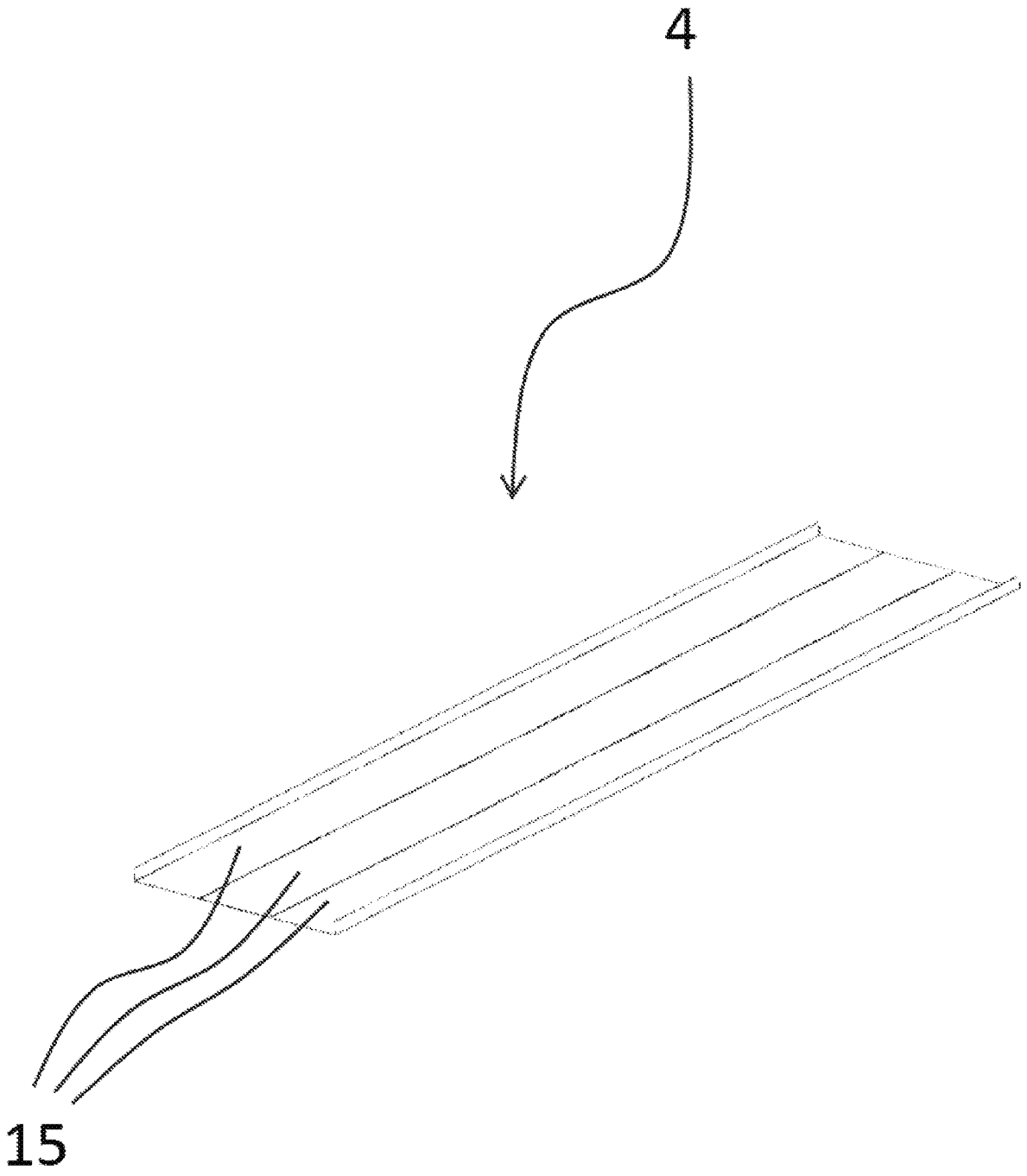
FIG. 9 shows a perspective view of a conductive member constituted by several conductive member pieces.

FIG. 8 and FIG. 9 respectively show a perspective view of conductive members 4. FIG. 8 shows a single piece conductive member provided with holes corresponding to notches 5 of the support structure 2. Alternatively, the conductive member does not have any holes or it is provided with holes which do not correspond to the notches 5 of the support structure. FIG. 9 shows a conductive member constituted by several conductive member pieces 15.

The conductive member 4 is formed as a conductive foil, the foil can be a thin sheet metal (metal foil), or a metallized plastic film. The foil can be provided with an adhesive layer for attaching it to a surface of the support structure.

Alternatively, the conductive foil can be designed in such a way that it includes an isolating layer above a metallization that acts as a dielectric layer, wherein, above refers to a side opposite to a support structure side. This permits an easy way of capacitive coupling of the conductive layer of the foil to another conductive element like, e.g., a conductive layer of a PCB.

Furthermore, the foil can include small cutouts that provide interconnection between elements on both sides of the foil and which do not affect the electrical function. Such cutouts can be used e.g. to interconnect the radiating elements on one side to a distribution network on the other side, to connect the radiating elements on the one side to the support structure on the other side e.g. by rivets or snap fit elements, or to connect other beam forming elements on the one side to the support structure on the other side.

Two conductive member pieces adjacent to one another can be attached in a capacitive coupling which means that the two adjacent conductive member pieces are isolated or separated from one another via an air gap or have overlapping insulated areas. Alternatively, two adjacent conductive member pieces have a galvanic DC connection which is formed by an overlapping non-insulated area or by a gap between the two conductive member pieces filled with e.g. a conductive glue.

Alternatively, the conductive member can be a printed circuit board which also can be flexible and which can be provided with a conductive layer on a required area thereof.

In a further alternative, the conductive member is realized by a metallization on a surface of the support structure 2. In this case, the support structure 2 is not electrically conductive and it does not have notches in order to provide an at most homogenous surface to support the metallization.

Depending on the requirements, the single piece conductive member or several conductive member pieces 15 are used. A single piece conductive member enables an efficient assembly, however, for specific functions of the antenna, several conductive member pieces 15 are used.

Figure 10:
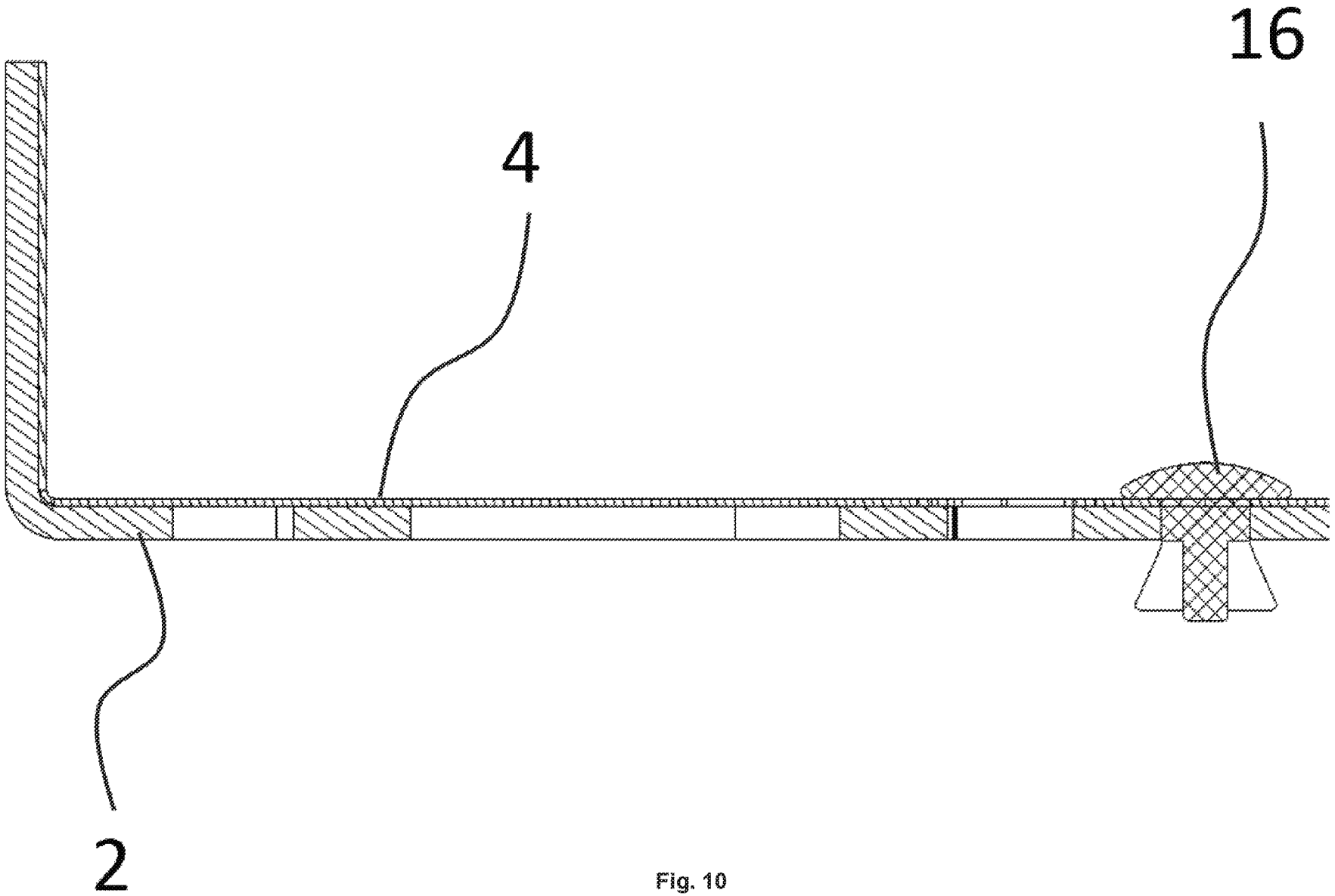
FIG. 10 shows a principle sectional side view of the support structure with the conductive member attached by a rivet.

In another embodiment, the conductive member 4 is configured to be attached to the support structure by mechanical fixtures. FIG. 10 shows a principle sectional side view of the support structure 2 with the conductive member 4 attached to the support structure 2 by a rivet 16.

Figure 11:
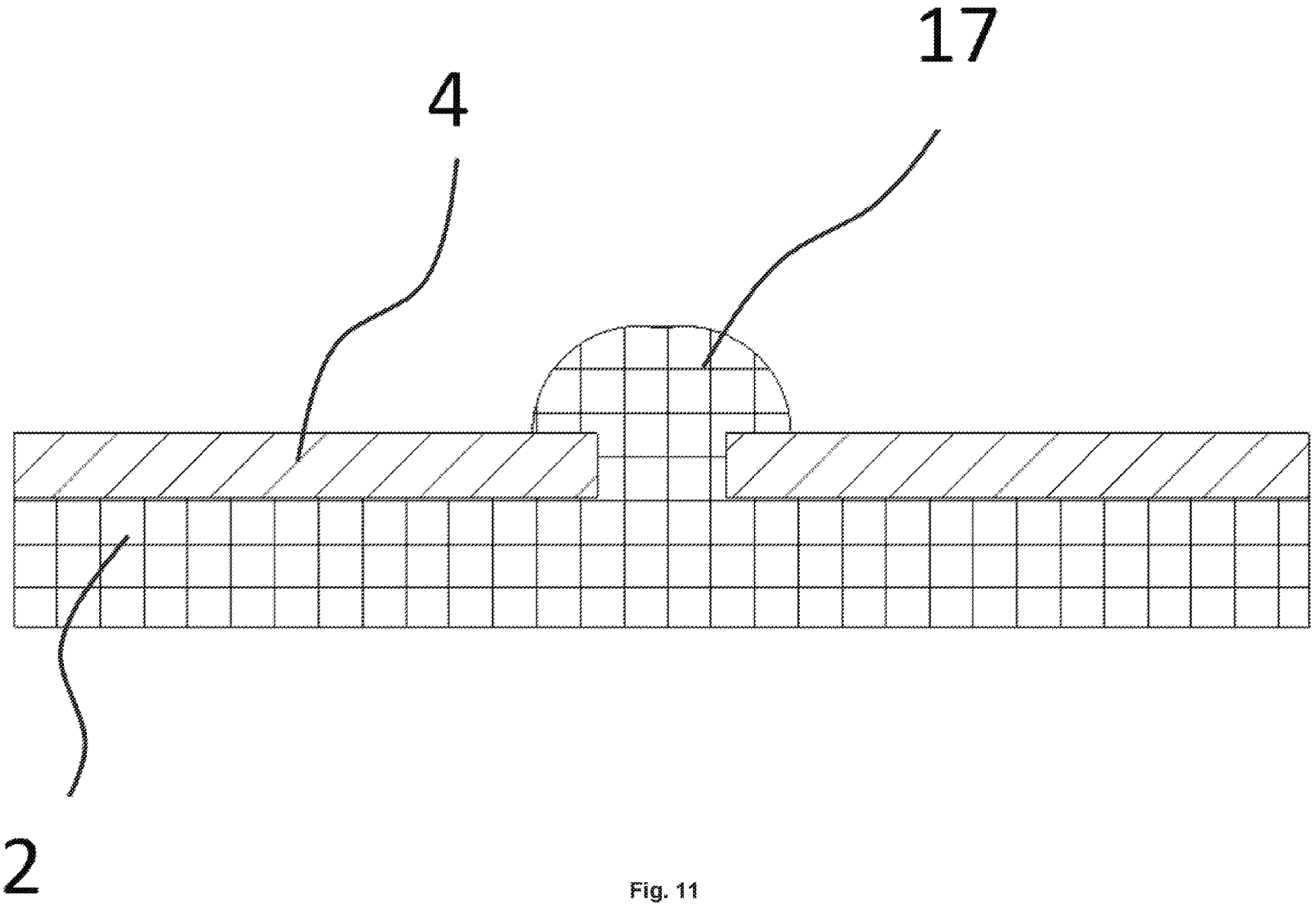
FIG. 11 shows a principle sectional side view of the support structure with the conductive member attached by a heat-staking feature.

FIG. 11 shows a principle sectional side view of the support structure 2 with the conductive member 4 attached to the support structure 2 by a heat-staking feature 17. The heat staking feature 17 is formed by a pin of the support structure 2 which is entered into a hole of the conductive member 4 and which is heated and pressed by an appropriate stamp so that the pin is provided with a bulge which fastens the conductive member 4 to the support structure 2.

In a further alternative embodiment, a chemical connection is used. For example, a polymer layer is put over the support structure 2 and is allowed to dry. Subsequently, the polymer layer is plated or a metallized layer is provided over the previously obtained surface by using techniques like aerosol jet printing or screen printing.

Although the present invention has been described with reference to specific features and embodiments thereof, it is evident that various modifications and combinations can be made thereto without departing from the spirit and scope of the invention. The specification and drawings are, accordingly, to be regarded simply as an illustration of the invention as defined by the appended claims, and are contemplated to cover any and all modifications, variations combinations or equivalents that fall within the scope of the present invention.

The invention claimed is:

1. A reflector for an antenna, the reflector comprising:

a support structure, the support structure configured to support at least one radiating element, wherein the support structure provides mechanical stiffness of the reflector; and a separate conductive member, the separate conductive member acting as an electrically reflective surface, the separate conductive member attached to the support structure and covering at least a portion of the support structure;

wherein the support structure comprises a plate-shaped section, wherein the plate-shaped section comprises a protruding portion, and wherein the protruding portion is formed by a cut out portion, wherein the cut out portion is separated from the plate-shaped section along a contour of at least one of one or more notches of the support structure except at an edge of a joint portion adjacent to the at least one of one or more notches, and wherein the cut out portion is folded along the edge such as being protruding from the plate-shaped section.

2. The reflector according to claim 1, wherein the support structure has a plurality of notches.

3. The reflector according to claim 2, wherein:

the support structure comprises support portions, the support portions configured to support the at least one radiating element, and the support structure comprises joint portions adjacent to the notches, wherein the support portions are connected to one another by the joint portions.

4. The reflector according to claim 3, wherein:

the support structure comprises an attachment portion, the attachment portion configured to attach the support structure to a housing of the antenna or to an external fixing system, and the support portions adjacent to the notches are connected to the attachment portion by the joint portions.

5. The reflector according to claim 3, wherein the joint portions are strut-shaped portions.

6. The reflector according to claim 2, wherein the separate conductive member covers at least some of the notches.

7. The reflector according to claim 2, wherein the support structure comprises at least one additional reinforcement member connected to at least one of the following: one of the support portions, or at least one of the joint portions adjacent thereto.

8. The reflector according to claim 1, wherein the protruding portion is formed by a piece of the cut out portion.

9. The reflector according to claim 1, wherein the protruding portion comprises a fixation element, the fixation element configured to fix a further member to the support structure or to fix the support structure to a housing of the antenna or to an external fixing system.

10. The reflector according to claim 1, wherein the support structure is made of sheet metal.

11. The reflector according to claim 1, wherein the support structure is made of a non-conductive material.

12. The reflector according to claim 1, wherein the separate conductive member is a conductive foil.

13. The reflector according to claim 1, wherein the separate conductive member is configured to be attached to the support structure by mechanical fixtures.

14. The reflector according to claim 1, wherein:

the support structure has a front side directed in a predetermined direction defined by a direction of beam of radio frequency (RF) signals of the antenna, and the separate conductive member is configured to be attached to the front side of the support structure.

15. The reflector according to claim 1, wherein:

the support structure has a backside averted from a predetermined direction defined by a direction of beam of RF signals of the antenna, and the separate conductive member is configured to be attached to the backside of the support structure.

* * * * *